United States Patent [19]

Lutz

[11] Patent Number: 4,726,484

[45] Date of Patent: Feb. 23, 1988

[54] PACKAGE EMPLOYING UNIQUE CLOSURE SEAL AND CONTAINER THEREFOR

[75] Inventor: Michael Lutz, Watchung, N.J.

[73] Assignee: Captive Plastics, Inc., Piscataway, N.J.

[21] Appl. No.: 944,471

[22] Filed: Dec. 19, 1986

[51] Int. Cl.[4] ..... B65D 41/04

[52] U.S. Cl. ..... 215/329; 215/344; 215/DIG. 1

[58] Field of Search ..... 215/344, 343, 345, DIG. 1, 215/31, 211, 214, 222, 223, 329, 341

[56] References Cited

U.S. PATENT DOCUMENTS

| | | | |
|---|---|---|---|
| 3,302,812 | 2/1967 | Busch et al. | 215/343 X |
| 3,360,149 | 12/1967 | Roth | 215/344 |
| 3,428,208 | 2/1969 | Kosar | 215/31 X |
| 3,684,116 | 8/1972 | Duffy | 215/211 |
| 3,881,627 | 5/1975 | Davolt | 215/344 X |
| 4,645,088 | 2/1987 | Menichetti | 215/344 X |

*Primary Examiner*—Donald F. Norton
*Attorney, Agent, or Firm*—Caesar, Rivise, Bernstein, Cohen & Pokotilow, Ltd.

[57] ABSTRACT

A package including a unique container adapted to cooperate with a closure for establishing a seal wherein the container includes a lower body section for receiving a material therein, and an upper, elongate finish joined to the body section. The finish includes an outer peripheral surface, and an inner peripheral surface defining a passageway communicating the finish with the interior of the lower body section of the container. The upper region of the finish has a stepped configuration in either one or both of the inner and outer peripheral surfaces thereof, and each stepped configuration includes a generally vertically oriented, circumferentially continuous surface segment extending for only a part of the elongate extent of the finish, and a horizontal, upwardly facing ledge section joined at a junction to the inwardly facing surface segment. Preferably the package includes a closure having an upper wall adapted to overlie the passageway defined by the inner peripheral surface of the finish, an outer peripheral skirt extending downwardly from the upper wall for attachment to the outer periphery of the finish and at least one flexible rib dimensioned so that its free end is forced into the junction between a generally vertically oriented surface segment and generally upwardly facing horizontal ledge section of a stepped configuration provided in the container finish, when the closure is tightly fastened to the container.

17 Claims, 4 Drawing Figures

15
12
10
22
16
54
20
24
18
58
56
48
26
52
42
44
14
40

PACKAGE EMPLOYING UNIQUE CLOSURE SEAL AND CONTAINER THEREFOR

FIELD OF THE INVENTION

This invention relates generally to a package, and more specifically to a package of the type employing a container and a closure for sealing same.

BACKGROUND ART

In the packaging of materials in general it is important to establish a seal that is effective to prevent leakage. The reliability of the seal becomes extremely important when the materials to be packaged are either caustic or otherwise harmful. For example, in the packaging of hair preparations that include ammonia, it is extremely important that the package seal be effective to prevent the escape of ammonia content.

Another application wherein a tight seal is required is in the packaging of soda and other carbonated beverages. It is well known that if an effective seal is not established, the carbonating gases will escape from the beverage before it is completely used, thereby resulting in the soda becoming "flat".

A packaging system which is becoming quite popular for retaining a wide variety of materials employs an injection, or extrusion blow molded container, which either can be opaque, translucent or transparent, and an injection molded closure therefor. Injection and extrusion blow molded containers or bottles can be made from a variety of different plastics, with one preferred plastic being a polyvinyl chloride that is formulated for use in an injection or extrusion blow molding process, as is well known in the art. A threaded closure for such a bottle or container can be made of low density polyethylene, polypropylene or other similar plastic material.

One way of providing a seal for a threaded container is to employ a threaded cap with an internal liner therein. However, this introduces an additional element into the construction, and thereby introduces additional material and labor costs into the fabricating process. Moreover, in the event that the liner becomes deteriorated or otherwise worn, the sealing capabilities thereof can be adversely effected, thereby resulting in undesired leakage. Leakage also can occur due to undesired tolerance variations in the manufacturing process, resulting in gaps or spaces between the internal liner and the upper surface of the container or bottle. Moreover, leakage can occur when the internal pressure in the container causes the top to "dome", thereby forcing the internal liner out of sealing engagement with the upper surface of the bottle.

Another well known arrangement for attempting to establish a seal between a closure and bottle is to include a downwardly projecting rib or fin on the inner surface of the cap for resiliently engaging an upper surface or edge of the bottle finish, when the closure is tightened onto the finish. The seal affected by this arrangement generally is created by either line contact between the fin and the upper edge or wall of the bottle finish, or by minimal surface engagement between said members. The effectiveness of this type of seal is largely dependent upon maintaining close tolerances in the manufacturing process. In the event that there are irregularities in the finish, resulting, for example, from tool marks or "blow by" in the molding process, undesired gaps can be created between the sealing surfaces, thereby causing undesired leakage of the packaged material.

OBJECTS OF THE INVENTION

It is a general object of this invention to provide a package which overcomes the problems encountered in prior art constructions.

It is a more specific object of this invention to provide a package in which an effective seal is established between a bottle and closure thereof.

It is a more specific object of this invention to provide an effective seal between a bottle and closure which is less susceptible to tolerance variations than prior art package constructions.

It is a further object of this invention to create an effective seal between a closure and container, wherein a flexible rib or fin forms part of the closure and cooperates with the container in forming the seal.

It is a more specific object of this invention to provide a package having a unique container for establishing an effective seal with a closure of the type having a flexible rib or fin projecting from an upper wall thereof.

SUMMARY OF THE INVENTION

The above and other objects of this invention are achieved by a package employing a container having an upper finish with outer and inner peripheral surfaces; said inner peripheral surface defining a passageway for material in the container. One or both of the inner and outer peripheral surfaces have a stepped configuration adjacent an upper edge of said finish, with each stepped configuration including a generally vertically oriented surface segment extending downwardly from a free end of the finish for only a portion of the length of said finish, and a generally horizontal, upwardly facing ledge section joined to a lower end of said generally vertically oriented surface segment at a junction.

In the preferred package construction the package includes a closure having an upper wall for overlying the passageway in the container, an outer skirt extending downwardly from the periphery of said upper wall for attachment to the container, and at least one flexible rib dimensioned so that its free end is forced into the junction between a generally vertically oriented surface segment and generally upwardly facing horizontal ledge section of a stepped configuration in the container finish, when the closure is tightly fastened on the finish. In this manner an effective seal is established by the rib being compressed into engagement with both the generally vertically oriented surface segment and upwardly facing ledge section of the stepped configuration.

In a preferred embodiment of the invention the stepped configuration is provided in the inner surface of the finish, and the flexible rib of the closure extends downwardly from the upper wall thereof and flares outwardly toward an inner surface of the outer skirt of the closure.

In an alternate embodiment of the invention the stepped configuration is provided in the outer surface of the finish, and the rib is positioned to be forced into the junction of the vertical oriented surface segment and horizontal ledge section of said stepped configuration.

In still another embodiment of the invention a stepped configuration is provided in each of the inner and outer surfaces of the finish. In this embodiment a closure is provided with two flexible ribs, each of which is forced into the junction between a generally vertically oriented surface segment and a generally horizontal ledge section of one of the stepped configurations.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
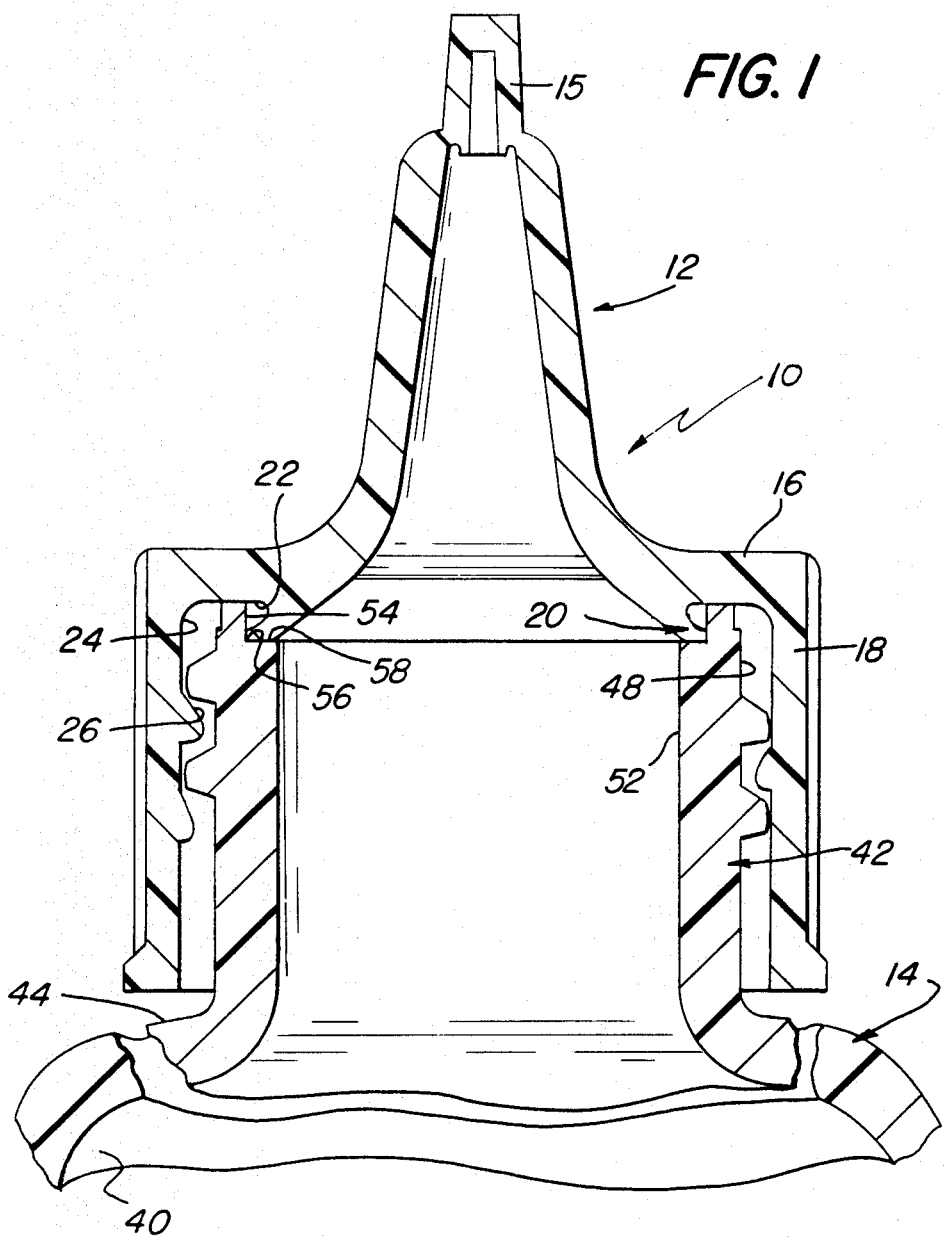
FIG. 1 is a sectional view of the upper portion of a preferred package of this invention, showing a closure thereof fully inserted onto the finish of a bottle to provide a leak-proof, sealed connection.

Referring now in greater detail to the various figures of the drawings wherein like reference characters refer to like parts, a preferred package embodying the present invention is generally shown at 10 in FIG. 1. The package 10 basically comprises a closure 12 for establishing a leak-proof seal with a container 14. In the most preferred embodiment of this invention the container 14 is an injection blow molded member formed of a unique construction, and is made from polyvinyl chloride or any other suitable material.

The closure 12 preferably is an injection molded part made from any of the well-known plastics usable in an injection molding process. In a preferred embodiment of the invention the closure 12 is made from a low density polyethylene material; however, other materials, such as high density polyethylene or polypropylene are believed to be suitable for use in this invention. In the illustrated embodiment the closure is of the type including a "snip-off" tip 15; however, the invention is equally adaptable to other closure constructions.

Figure 2:
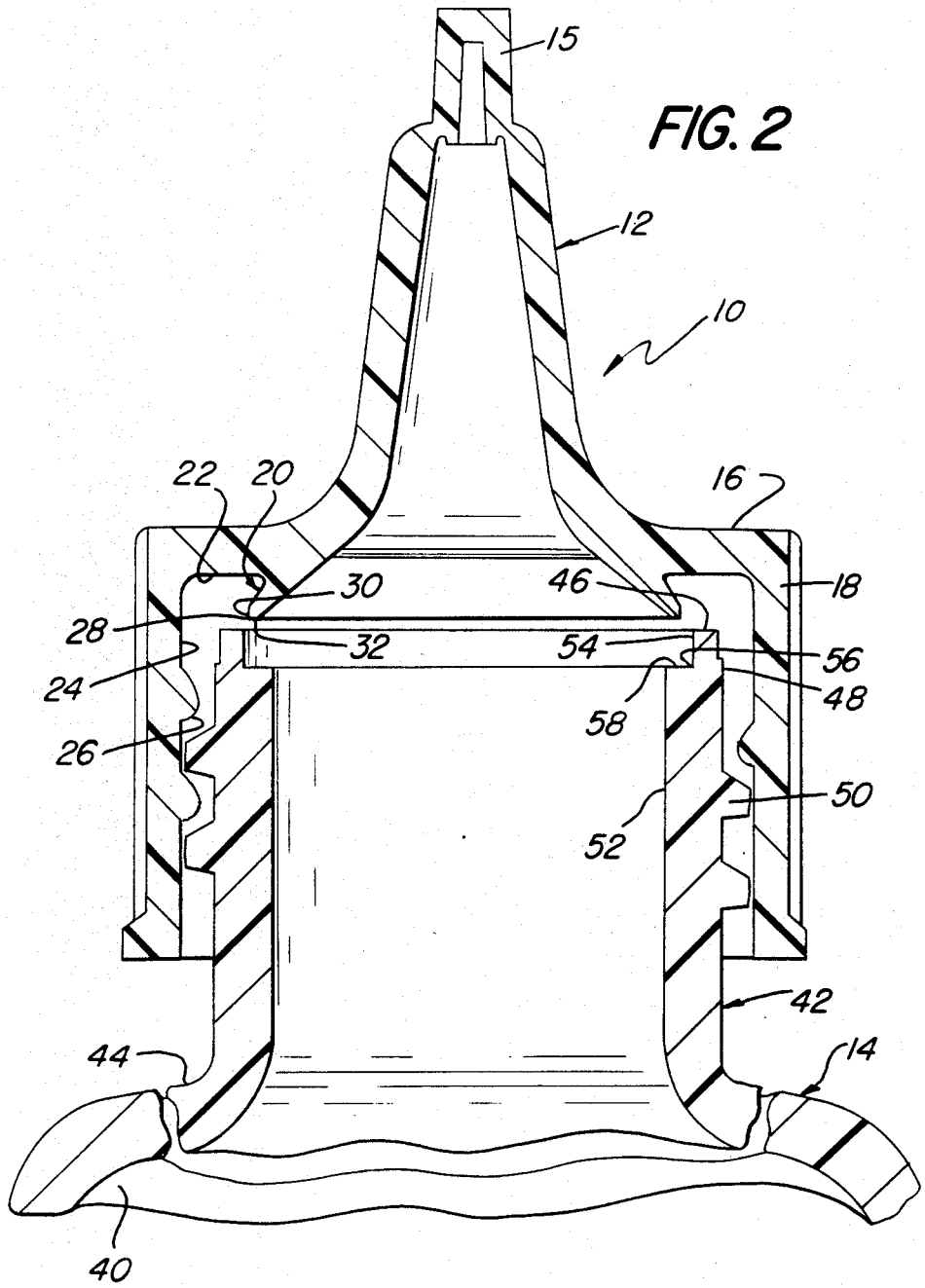
FIG. 2 is a view similar to FIG. 1 but showing the position of the closure on the finish of the bottle, just prior to establishing the leak-proof seal shown in FIG. 1.

Referring to FIGS. 1 and 2, the closure 12 includes an upper wall 16 having an outer skirt 18 extending downwardly from the periphery of said upper wall. An inner rib or fin 20 is generally conical, and extends downwardly and outwardly from downwardly facing inner surface 22 of the upper wall 16.

The outer skirt 18 includes an inner wall 24 which also extends down from the downwardly facing surface 22 of upper wall 16, and this inner wall includes a threaded section 26 thereon for cooperating with complimentary threads on the container 14, as will be discussed hereinafter.

The inner rib or fin 20 has a vertical height of approximately 0.065 inches, and terminates at an outer free edge 28, which forms the junction of a generally planar, outwardly facing vertical surface 30 and a generally planar, downwardly facing horizontal surface 32 of the fin 20. It should be noted that, in the preferred embodiment of this invention, the vertical height of the rib or fin 20 is substantially smaller than the overall height of the skirt 18. In an exemplary embodiment of this invention the inner wall 24 of the skirt 18 has a vertical dimension of approximately 0.525 inches. Thus, in a preferred embodiment of this invention the vertical height of the rib 20 is less than 15% of the vertical height of the inner wall 24 of the skirt 18, with the most preferred relationship being approximately 12.5%.

Referring to the drawings, and in particular FIG. 2, the container or bottle 14 includes a lower body section, only a portion of which is shown at 40, in which material to be packaged is retained. An upper elongate finish 42 is joined to the body section 40 through a generally horizontal, transitional wall portion 44. It should be understood that the container or bottle 12 can take on many different configurations, the important feature being that it includes a finish in which the unique structure to be described hereinafter can be formed for cooperating with the fin or rib 20 of the closure 12.

The finish 42 includes an upper free end 46, an outer peripheral surface 48 having threads 50 thereon for cooperating with the threaded section 26 of the closure 12, and an inner peripheral surface 52 defining a passageway in communication with the interior of the body section 40. In the embodiment illustrated in FIGS. 1 and 2, the inner surface 52 is provided with a stepped configuration adjacent its upper end to define a generally vertically oriented, inwardly facing, circumferentially continuous surface segment 54 extending downwardly from the free end 46 of the finish for only a short distance, said surface segment being joined at a junction 56 to a generally horizontal, upwardly facing and inwardly directed ledge section 58. In an exemplary embodiment of this invention, the inwardly facing surface segment 54 has a vertical length in the range of 0.041 to 0.051 inches in a container having an inner peripheral surface 52 which is slightly greater than 0.5 inches. In the preferred embodiment of this invention the inwardly facing surface segment 54 constitutes less than 10% of the overall length of the inner surface 52 of the finish 42.

In an exemplary embodiment of the container 12, the horizontal ledge section 58 is approximately 0.050 inches. As stated earlier, the horizontal ledge section 58 joins the inwardly facing surface segment 54 at a junction 56. This junction, in a preferred embodiment of the invention, is in the form of a continuous, circular edge.

Referring specifically to FIG. 2, the general relationship between the closure 12 and the finish 42 of the container 14 is illustrated when the closure 12 is only partially engaging the finish of the container. It should be noted that the free end of the fin 20 initially will engage the upwardly facing ledge section 58 as the closure 12 is being tightened on the bottle finish 42.

As can be seen in FIG. 1, when the closure 12 is completely threaded onto the finish of the container 14, the inner rib or fin 20 is jammed into the corner, or junction 56, of the stepped region of the container finish 42, such that the rib is compressed against both the inwardly facing surface segment 54 and the upwardly facing ledge section 58 to effect an extremely reliable seal in two, mutually perpendicular planes.

Applicant has found that the seal established between the compressed rib or fin 20 and the inner surface 54 and upwardly facing ledge section 58 of the finish 42 is exceptionally reliable, virtually eliminating all leakage under various conditions of use.

Applicant believes that in addition to the compression, or interference generated by forcing the rib 20 against the mutually perpendicular surfaces in the inner stepped region of the finish 42, an additiional or subsequent sealing effect exists or takes place if there is a positive or negative pressure in the container, relative to the surrounding environment. Under the influence of a positive pressure within the container, the outwardly directed force may tend to actually lift the rib or fin 20 in a direction outwardly of the upper ledge section 58. However, this same force tends to further compress the rib 20 against the inwardly facing surface segment 54. On the other hand, if a negative pressure is present, i.e., if the external pressure on the package 10 is greater than the internal pressure, the force imposed upon the closure, and possibly the rib or fin 20, is in a direction to further force the rib against the ledge 58, thereby enhancing the seal against that surface.

Figure 3:
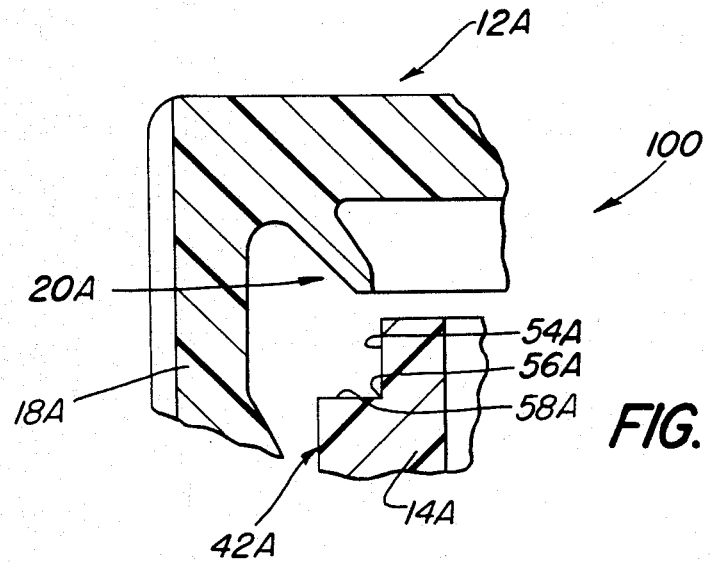
FIG. 3 is a fragmentary sectional view similar to FIG. 2, showing the position of a closure on the finish of a bottle in accordance with an alternate embodiment of this invention.

Referring to FIG. 3, an alternate embodiment of a package 100 in accordance with this invention includes a container 14A having a finish 42A which is identical in all respects to the finish 42 of the container 14, except that the stepped configuration adjacent the upper edge of the finish is provided in the outer periphery thereof. This stepped configuration is defined by a generally vertically oriented surface segment 54A, which faces in an outward direction, and a generally upwardly facing ledge section 58A, which extends outwardly from a junction 56A at which surface segment 54A meets upwardly facing ledge section 58A. The dimensions of the surface segment 54A and ledge section 58A preferably are the same as the corresponding dimensions in the container 14.

Still referring to FIG. 3, a closure 12A in accordance with this embodiment of the invention is similar to the closure 12 of the package 10, but differs therefrom in that fin 20A is located in the region between the outer skirt 18A and finish 42A of the container, and flares inwardly so as to be forced into the junction 56A between the generally vertically oriented surface segment 54A and upwardly facing ledge section 58A, when the closure 12A is tightened on the finish 42A. The fin 20A cooperates with the outer stepped configuration in substantially the same manner as the rib 20 cooperates with the inner stepped configuration of the package 10. That is, when the rib 20A is forced into the outer stepped configuration, it will be compressed against both the upwardly facing horizontal ledge section 58A and the outwardly facing vertical surface segment 54A to provide a compressive seal in two mutually perpendicular directions.

Figure 4:
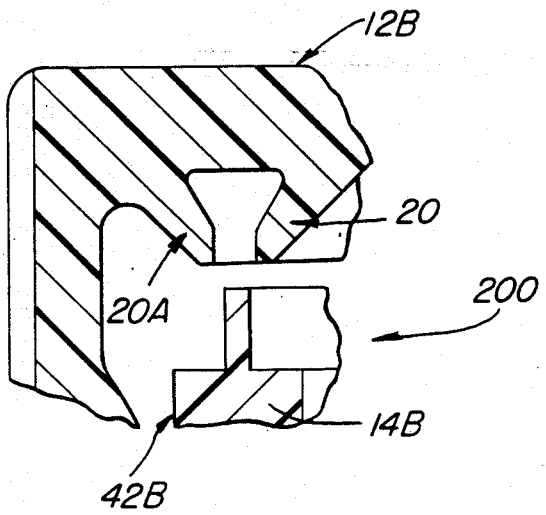
FIG. 4 is a fragmentary sectional view similar to FIG. 3, but showing still another embodiment of this invention.

Referring to FIG. 4 still a further embodiment of a package in accordance with this invention is generally shown as 200. In this package a container 14B includes both an inner stepped configuration and an outer stepped configuration adjacent the upper edge of the finish 42B. Both stepped configurations preferably have the same dimensions as in the container 14 of the package 10.

As can be seen in FIG. 4, the closure 12B actually is a composite of both closure 12 of the package 10 and the closure 12A of the package 100. That is, the closure 12B is provided with both an outwardly directed flexible fin 20 and an inwardly directed flexible fin 20A to cooperate, respectively, with the inner and outer stepped configurations provided in the finish 42B, in exactly the same manner as described above in connection with the packages 10 and 100. That is, each of the fins 20 and 20A will be compressed into engagment with mutually perpendicular surfaces associated with the inner and outer stepped configurations, respectively. Thus, four circumferential seals are provided within the package 200.

Without further elaboration, the foregoing will so fully illustrate my invention that others may, by applying current or future knowledge, adopt the same for use under various conditions of service.

What is claimed as the invention is:

1. A package including a closure and a container cooperating with the closure for establishing a seal, said container including a lower body section for receiving a material therein and an upper elongate finish joined to said body section, said upper elongate finish having an outer peripheral surface and an inner peripheral surface, said inner peripheral surface defining a passageway in communication with the body section, a peripheral surface of said finish adjacent an upper edge thereof having a stepped configuration including a generally vertically oriented surface segment extending downwardly from a free end of said finish and a generally horizontal, upwardly facing ledge section joined to said generally vertically oriented surface segment at a junction, said closure having an upper wall for overlying the passageway in communication with the body section of the container, an outer skirt extending downwardly from the upper wall adjacent the periphery thereof and an inner flexible rib extending downwardly at an angle from an inner surface of the upper wall in a direction toward the junction of the stepped configuration and being dimensioned to be compressed into engagement with both the ledge section and the generally vertically oriented surface segment when the closure is moved into a closed position on the container to thereby establish a leak-proof seal between said closure and container, the inner surface of the outer skirt and the outer peripheral surface of the finish including cooperating threads to permit the closure to be moved into said closed positions by rotation of the closure relative to said container.

2. The package of claim 1 wherein the generally vertically oriented surface segment, generally horizontal, upwardly facing ledge section and junction are circumferentially continuous.

3. The package of claim 1 wherein the elongate dimension of the generally vertically oriented surface segment is no greater than 10% of the elongate dimension of the inner peripheral surface of the elongate finish.

4. The package of claim 3 wherein the rib of the closure has a substantially conical shape.

5. The closure of claim 3 wherein the elongate dimension of the rib is less than 15% of the elongate dimension of the inner surface of the outer skirt.

6. The package of claim 1 wherein the stepped configuration is provided in the inner peripheral surface of the finish and includes a generally inwardly facing, vertically oriented surface segment extending downwardly from a free end of said finish and a generally horizontal, upwardly facing and inwardly directed ledge section joined to said inwardly facing surface segment at a junction.

7. The package of claim 6 wherein the elongate dimension of the inwardly facing surface segment is no greater than 10% of the elongate dimension of the inner peripheral surface of the elongate finish.

8. The package of claim 6 wherein said threads adapted to cooperate with corresponding thread means of a closure, said thread means on the outer peripheral surface are located solely in a region spaced longitudinally below the upwardly facing ledge section.

9. The package of claim 6 wherein the generally vertically oriented surface segment, generally horizontal, upwardly facing ledge section and junction are circumferentially continuous.

10. The package of claim 6 wherein said inner flexible rib extending downwardly from an inner surface of said upper wall flares outwardly toward an inner surface of the outer skirt in a direction from the inner surface of said upper wall to a free end of said rib, the free end of said rib being dimensioned to be compressed into engagement with both the ledge section and inwardly facing surface segment at the upper end of the finish when the closure is rotated into the closed position on the container to thereby establish the leak-proof seal between said closure and container.

11. The package of claim 10 wherein the inner rib of the closure has a substantially conical shape.

12. The closure of claim 10 wherein the elongate dimension of the rib is less than 15% of the elongate dimension of the inner surface of the outer skirt.

13. The package of claim 1 wherein a stepped configuration is provided in both the outer peripheral surface and the inner peripheral surface of the finish adjacent an upper edge thereof, the stepped configuration in the inner peripheral surface including a generally vertically oriented, inwardly facing surface segment extending downwardly from the free end of said finish and a generally horizontal, upwardly facing and inwardly extending ledge section joined to said inwardly facing surface segment at a junction, and said stepped configuration provided in the outer peripheral surface including a generally vertically oriented, outwardly facing surface segment extending downwardly from a free end of the finish and a generally horizontal, upwardly facing and outwardly directed ledge section joined to said outwardly facing surface segment at a junction, said closure including a pair of inner flexible ribs, one of said ribs extending downwardly at an angle from the inner surface of the upper wall in a direction toward the junction of the stepped configuration in the inner peripheral surface of the finish and the other of the flexible ribs extending downwardly from the inner surface of the upper wall in a direction toward the junction of the stepped configuration in the outer peripheral surface of the finish, said pair of flexible ribs being dimensioned to be pressed into engagement with both the ledge section and the generally vertically oriented surface segment of the stepped configurations in both the outer and inner peripheral surfaces of the finish when the closure is rotated into the closed position on the container to thereby establish the leak-proof seal between the closure and the container.

14. The package of claim 13 wherein the elongate dimension of both the inwardly and outwardly facing surface segments is no greater than 10% of the elongate dimension of the inner peripheral surface of the elongate finish.

15. The package of claim 13 wherein the generally vertically oriented surface segments, generally horizontal, upwardly facing ledge sections and junctions are all circumferentially continuous.

16. A package including a closure and a container cooperating with the closure for establishing a seal, said container including a lower body section for receiving a material therein and an upper elongate finish joined to said body section, said upper elongate finish having an outer peripheral surface and an inner peripheral surface, said inner peripheral surface defining a passageway in communication with the body section, a stepped configuration provided in both the outer peripheral surface and the inner peripheral surface of the finish adjacent an upper edge of said finish, the stepped configuration in the inner peripheral surface including a generally vertically oriented, inwardly facing surface segment extending downwardly from the free end of said finish and a generally horizontal, upwardly facing and inwardly extending ledge section joined to said inwardly facing surface segment at a junction, and said stepped configuration provided in the outer peripheral surface including a generally vertically oriented, outwardly facing surface segment extending downwardly from a free end of the finish and a generally horizontal, upwardly facing and outwardly directed ledge section joined to said outwardly facing surface segment at a junction, said closure having an upper wall adapted to overlie the passageway in communication with the body section, an outer skirt extending downwardly from the upper wall adjacent the periphery thereof, and a pair of flexible ribs extending in a direction away from an inner surface of said upper wall, one of said ribs being dimensioned to be compressed into engagement with both the ledge section and the outwardly facing, generally vertically oriented surface segment defining the stepped configuration in the outer peripheral surface of the finish, and the other rib being dimensioned to be compressed into engagement with both the ledge section and the inwardly facing, generally vertical oriented surface segment defining the stepped configuration in the inner surface of the finish, when the closure is moved into a closed position on the container to thereby establish a leak-proof seal between the closure and the container.

17. The package of claim 16 wherein each of said ribs extend downwardly from an inner surface of said upper wall, one of said ribs flaring outwardly toward an inner surface of the skirt in a direction from the inner surface of said upper wall to a free end of said rib, and the other rib flaring inwardly away from said inner surface of the outer skirt in a direction from the inner surface of said upper wall to a free end of said other rib, said one rib being compressed into the stepped configuration defined by the inwardly facing surface segment and the inwardly directed horizontal ledge section, and the other rib being compressed into the stepped configuration defined by the outwardly facing surface segment and the outwardly directed horizontal ledge section defining the outer stepped configuration.

* * * * *